US009103256B2

(12) United States Patent
Mitsuda

(10) Patent No.: US 9,103,256 B2
(45) Date of Patent: Aug. 11, 2015

(54) EXHAUST EMISSION CONTROL DEVICE

(71) Applicant: YANMAR CO., LTD., Osaka (JP)

(72) Inventor: Masataka Mitsuda, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 0 days.

(21) Appl. No.: 14/372,390

(22) PCT Filed: Jan. 8, 2013

(86) PCT No.: PCT/JP2013/050114
§ 371 (c)(1),
(2) Date: Jul. 15, 2014

(87) PCT Pub. No.: WO2013/108667
PCT Pub. Date: Jul. 25, 2013

(65) Prior Publication Data

US 2014/0352282 A1 Dec. 4, 2014

(30) Foreign Application Priority Data

Jan. 19, 2012 (JP) ..... 2012-008946
Jan. 19, 2012 (JP) ..... 2012-008947

(51) Int. Cl.
*F01N 3/00* (2006.01)
*F01N 3/18* (2006.01)
(Continued)

(52) U.S. Cl.
CPC *F01N 3/18* (2013.01); *F01N 3/005* (2013.01); *F01N 3/035* (2013.01); *F01N 3/106* (2013.01);
(Continued)

(58) Field of Classification Search
CPC . F02D 41/029; F02D 41/1448; F01N 3/2842; F01N 3/106; F01N 13/008; F01N 3/005
USPC ..... 60/282
See application file for complete search history.

(56) References Cited

U.S. PATENT DOCUMENTS 8,549,847 B2 10/2013 Kamiya et al.
8,635,864 B2 1/2014 Yamamoto
(Continued)

FOREIGN PATENT DOCUMENTS

JP 2001-073748 3/2001
JP 2004-263593 9/2004
(Continued)

OTHER PUBLICATIONS

English translation of Japanese Patent Application JP 2011-179384 A (Sep. 2011).*
(Continued)

*Primary Examiner* — Thomas Denion
*Assistant Examiner* — Jason Shanske
(74) *Attorney, Agent, or Firm* — Jordan and Hamburg LLP

(57) ABSTRACT

An object is to reduce man-hours for evaluations of design, test, and the like for securing an exhaust gas purifier to an engine, while also making the exhaust gas purifier more compact. The exhaust gas purifier includes a plurality of filter bodies and to purify exhaust gas discharged from the engine, a purification casing including a plurality of purification cases that house the filter bodies, an exhaust gas pressure sensor to detect an exhaust gas pressure in the purification casing, and an exhaust gas temperature sensor to detect an exhaust gas temperature in the purification casing. The two sensors are disposed on the outer circumferential side of the purification casing so as to fit in the length range in the purification casing in the exhaust gas flow direction.

6 Claims, 12 Drawing Sheets

(51) Int. Cl.

| | |
|---|---|
| ***F02D 41/02*** | (2006.01) |
| ***F02D 41/14*** | (2006.01) |
| ***F01N 3/10*** | (2006.01) |
| ***F01N 3/28*** | (2006.01) |
| ***F01N 13/00*** | (2010.01) |
| ***F01N 3/035*** | (2006.01) |
| *F01N 13/18* | (2010.01) |
| *F01N 3/021* | (2006.01) |

(52) U.S. Cl.

CPC ..... *F01N 3/2842* (2013.01); *F01N 13/008* (2013.01); *F02D 41/029* (2013.01); *F02D 41/1446* (2013.01); *F02D 41/1448* (2013.01); *F01N 3/0211* (2013.01); *F01N 13/1805* (2013.01); *F01N 2450/24* (2013.01); *F01N 2450/30* (2013.01); *F01N 2470/18* (2013.01); *F01N 2470/24* (2013.01); *F01N 2560/06* (2013.01); *F01N 2560/08* (2013.01); *F02D 2200/0812* (2013.01)

(56) References Cited

U.S. PATENT DOCUMENTS

| | | | |
|---|---|---|---|
| 2011/0030353 | A1 | 2/2011 | Kamiya et al. |
| 2011/0138794 | A1 | 6/2011 | Yamamoto |

FOREIGN PATENT DOCUMENTS

| | | |
|---|---|---|
| JP | 2005-194949 | 7/2005 |
| JP | 2009-091982 | 4/2009 |
| JP | 200-228516 | 10/2009 |
| JP | 2010-007556 | 1/2010 |
| JP | 2010-043546 | 2/2010 |
| JP | 2010-043574 | 2/2010 |
| JP | 2010444640 | 7/2010 |
| JP | 2011-179384 | 9/2011 |
| WO | WO-2008/136203 | 11/2008 |

OTHER PUBLICATIONS

English translatiion of Japanese Patent Application JP 2010-7556 A (Jan. 2010).*

* cited by examiner

EXHAUST EMISSION CONTROL DEVICE

TECHNICAL FIELD

The present invention relates to an exhaust emission control device to be mounted on a diesel engine or the like, and more particularly to an exhaust emission control device to remove particulate matter contained in exhaust gas (soot, and particulates), or the like.

BACKGROUND OF THE INVENTION

There has been a conventionally well-known technology that a diesel particulate filter (hereinafter referred to as "DPF") is disposed as an exhaust emission control device in an exhaust passage of a diesel engine (hereinafter referred to simply as "engine") so as to subject exhaust gas discharged from the engine to purification process in the DPF (see patent document 1). There has also been well-known technologies of disposing in the DPF an exhaust gas temperature sensor to detect a temperature of the exhaust gas discharged from the engine and an exhaust gas pressure sensor to detect a pressure of the exhaust gas discharged from the engine (see patent documents 1 and 5).

Further, there has been a well-known technology that an inside case is disposed in the interior of an outside case so as to have a double structure in the DPF, and the inside case houses oxidization catalyst or a soot filter, or the like (see, for example, patent document 3). There has also been well-known technologies that a case storing the oxidization catalyst and a case storing the soot filter are separatably coupled to each other with a bolted flange interposed between the cases (see, for example, patent documents 3 and 4).

RELATED ART DOCUMENTS

Patent document 1: Japanese Unexamined Patent Application No. 2004-263593.

Patent document 2: Japanese Unexamined Patent Application No. 2005-194949.

Patent document 3: Japanese Unexamined Patent Application No. 2009-228516.

Patent document 4: Japanese Unexamined Patent Application No. 2009-91982.

Patent document 5: Japanese Unexamined Patent Application No. 2001-73748.

With the above conventional technologies, however, when the exhaust gas pressure sensor and the exhaust gas temperature sensor are disposed on the engine and a working machine side on which the engine is mounted, it is necessary to evaluate suitability of an initial setting (adjustment) situation of the individual sensors for every specification of the engine and every working machine. Therefore, the above conventional technologies have suffered from the problem that it is difficult to reduce man-hours for evaluations of design and test for securing the DPF to the engine. From this point of view, securing the individual sensors to the DPF eliminates the need to evaluate the DPF for every specification of the engine, but leads to the problem that it is not easy to ensure rigidity of a purification casing constituting the DPF and support strength with respect to the individual sensors.

SUMMARY OF THE INVENTION

It is a technological object of the present invention to provide an exhaust emission control device in which improvements have been made in consideration of the present situation as described above.

According to the invention of claim 1, there is provided an exhaust emission control device including a plurality of filter bodies to purify exhaust gas discharged from an engine, a purification easing including a plurality of purification cases respectively housing the plurality of filter bodies, an exhaust gas pressure sensor to detect an exhaust gas pressure in the purification casing, and an exhaust gas temperature sensor to detect an exhaust gas temperature in the purification casing. The exhaust gas pressure sensor and the exhaust gas temperature sensor are disposed along an outer circumferential side of the purification casing so as to fit in a length range of the purification casing in an exhaust gas flow direction.

According to the invention, in the exhaust emission control device, a sensor bracket may be detachably secured to a sensor support portion disposed on a part of flanges of a group of the purification cases, and the exhaust gas pressure sensor and the exhaust gas temperature sensor may be disposed on the sensor bracket.

In an exhaust emission control device according to the invention, the sensor support portion may be disposed on a part of the flange in the group of the purification cases that is farthermost from an exhaust gas inlet side. A horizontal plate portion of the sensor bracket may be located at a position outwardly separated from an outer circumferential side of the purification casing. The exhaust gas pressure sensor and the exhaust gas temperature, sensor may be disposed side by side on the horizontal plate portion.

According to the invention, the exhaust emission control device may further include a plurality of inside cases respectively housing the filter bodies and a plurality of outside cases respectively housing the inside cases. The outside cases may be coupled to each other side by side in the exhaust gas flow direction so as to constitute the purification casing. Lid bodies may be respectively to close both end portions of the purification casing in the exhaust gas flow direction. Each of the lid bodies may be made into a double structure made up of an inner lid body and an outer lid body. A first drain hole to drain water that accumulates between the inner lid body and the outer lid body may be disposed on at least a portion located at a lower part of the outer lid body in a state in which the purification casing is mounted on the engine.

According to the invention, in the exhaust emission control device, the first drain hole may be disposed at a position in a radial direction based on a centerline in the exhaust gas flow direction in the outer lid body.

In an exhaust emission control device according to the invention, a second drain hole to drain water that accumulates between the inside cases and the outside cases may be disposed on at least a portion located at a lower part of each of the outside cases in the state in which the purification casing is mounted on the engine.

With the present invention, the exhaust emission control device includes the plurality of filter bodies to purify the exhaust gas discharged from the engine, the purification casing including the plurality of purification cases respectively housing the plurality of filter bodies, the exhaust gas pressure sensor to detect the exhaust gas pressure in the purification casing, and then exhaust gas temperature sensor to detect the exhaust gas temperature in the purification casing. In the exhaust emission control device, the exhaust gas pressure sensor and the exhaust gas temperature sensor are disposed along the outer circumferential side of the purification casing so as to fit in the length range of the purification casing in the exhaust gas flow direction. It is therefore unnecessary to evaluate suitability of initial setting (adjustment) of the individual sensors for every specification of the engine and every working machine. This ensures reduction in man-hours for evaluations of design, test, and the like. This also achieves standardization of the components related to the exhaust emission control device. Mounting positions of the two sensors fit in the length range in the purification casing in the exhaust gas flow direction. This eliminates the influence of the two sensors on the full length of the purification casing (exhaust emission control device) in the exhaust gas flow direction, and consequently ensures a compact layout of the exhaust emission control device including the two sensors in layout space for the engine.

With the invention, the sensor bracket is detachably secured to the sensor support portion disposed on the part of the flanges of the group of the purification cases, and the exhaust gas pressure sensor and the exhaust gas temperature sensor are disposed on the sensor bracket. Therefore, the two sensors are supported on the highly rigid flanges so as to reduce vibrations transmitted to the two sensors. It is therefore ensured to suppress adverse effects on detection accuracy of the two sensors. It is also ensured to prevent the two sensors from falling.

With the invention, the sensor support portion is disposed on the part of the flange in the group of the purification cases that is farthermost from the exhaust gas inlet side. The horizontal plate portion of the sensor bracket is located at the position outwardly separated from the outer circumferential side of the purification casing. The exhaust gas pressure sensor and the exhaust gas temperature sensor are disposed side by side on the horizontal plate portion. Therefore, heat generated from the exhaust emission control device is less likely to be transmitted to the two sensors. Hence, though the two sensors are incorporated in the exhaust emission control device, it is ensured to suppress malfunction of the two sensors due to overheat. Moreover, the exhaust emission control device and the two sensors are close, to each other, and hence the length of the individual sensor pipes that couple the exhaust emission control device and the two sensors can be set short so as to improve mounting work efficiency and achieve cost savings.

With the invention, the exhaust emission control device further includes the plurality of inside cases respectively housing the filter bodies and the plurality of outside cases respectively housing the inside cases. The outside cases are coupled to each other side by side in the exhaust gas flow direction so as to constitute the purification casing. The lid bodies are respectively to close both end portions of the purification casing in the exhaust gas flow direction. Each of the lid bodies is made into the double structure made up of the inner lid body and the outer lid body. The first drain hole to drain water that accumulates between the inner lid body and the outer lid body is disposed on at least the portion located at the lower part of the outer lid body in the state in which the purification casing is mounted on the engine. Both end portions of the purification easing in the exhaust gas flow direction are closed by the double structure made up of the inner lid body and the outer lid body so as to ensure heat insulation properties, while the water that accumulates between the inner lid body and the outer lid body due to water condensation, rainwater, or the like can be discharged from the first drain holes so as to improve water draining capability of the exhaust emission control device. This contributes to improving corrosion resistance of the exhaust emission control device.

With the invention, the first drain holes are respectively disposed at the positions in the radial direction based on the centerline in the exhaust gas flow direction in the outer lid bodies. It is ensured that both end portions of the purification casing in the exhaust gas flow direction are closed by the outer lid bodies having the same shape. This leads to a decrease in the number of components so as to contribute to cost savings. A mounting direction around the centerline of the outer lid bodies with respect to the individual end portions of the purification casing in the exhaust gas flow direction can be changed easily without changing the shape of the outer lid bodies. Consequently, it is ensured to enhance latitude of a mounting direction of the outside cases with respect to the engine.

With the invention, the second drain hole to drain water that accumulates between the inside cases and the outside cases is disposed on at least the portion located at the lower part of each of the outside cases in the state in which the purification casing is mounted on the engine. Therefore, the purification casing is made into the double structure made up of the inside case and the outside case so as to ensure heat insulation properties, while the water that accumulates between the inside cases and the outside cases due to water condensation, rainwater, or the like can be discharged from the second drain holes so as to improve water draining capability of the exhaust emission control device. This contributes to further improving the corrosion resistance of the exhaust emission control device.

DETAILED DESCRIPTION OF THE PREFERRED EMBODIMENTS

Figure 1:
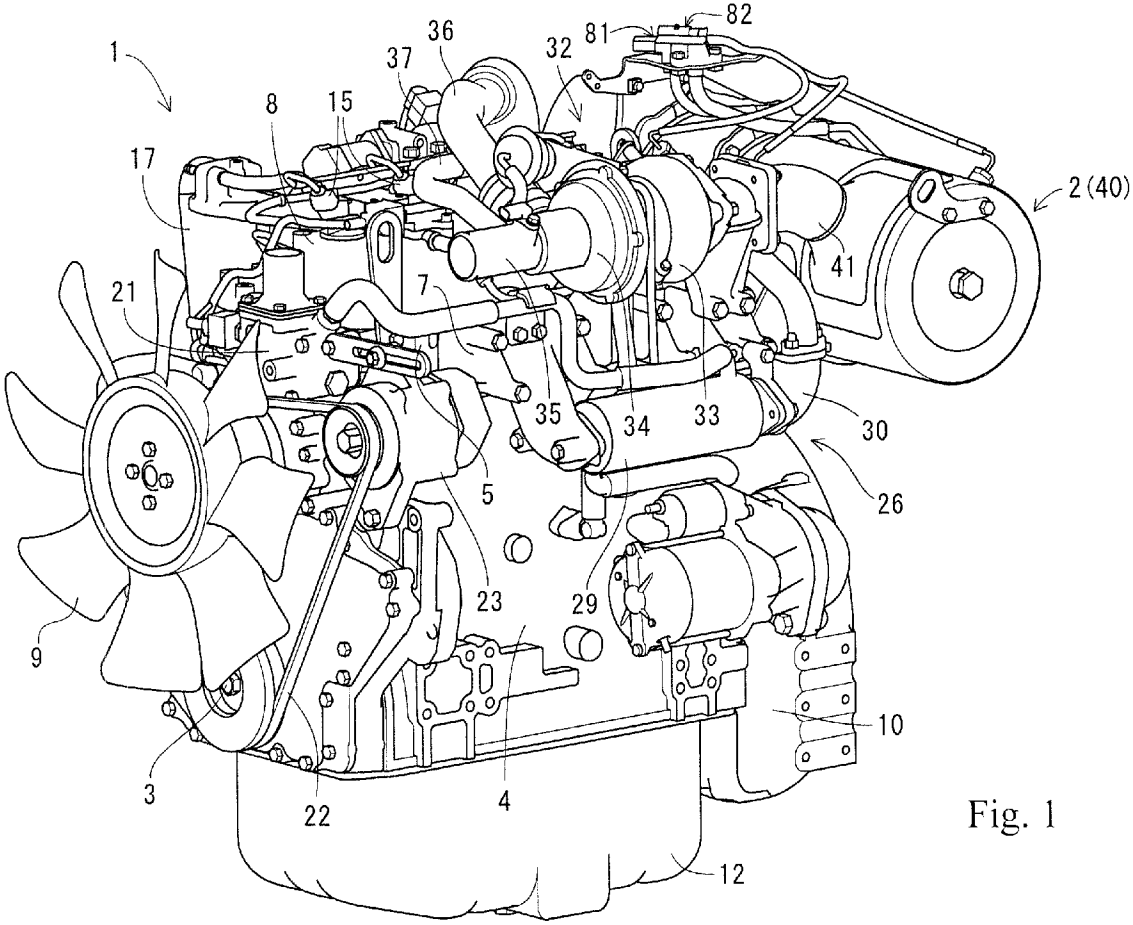
FIG. 1 is a perspective view seen obliquely from the front of an engine.

An embodiment of the present invention will be described below based on the drawings.

(1) General Structure of Engine

First, a general structure of an engine 1 of a common rail engine 1 will be described by referring to FIGS. 1 to 6. In the following description, both side parts parallel to a crank axis (both side parts across the crank axis) are respectively taken as left and right, the side on which a cooling fan 9 is disposed is taken as a front side, the side on which a flywheel housing 10 is disposed is taken as a back side, the side on which an exhaust manifold 7 is disposed is taken as a left side, and the side on which an intake manifold 6 is disposed is taken as a right side. For the sake of convenience, these are used as a basis for positional relationships of all sides and top and bottom in the engine 1.

As shown in FIGS. 1 to 6, the engine 1 as a motor to be mounted on a working machine, such as an agricultural machine, and a civil engineering construction machine, includes a continuous regeneration type exhaust emission control device 2 (diesel particulate filter, hereinafter referred to as "DPF"). The DPF 2 removes particulate matter (PM) in exhaust gas discharged from the engine 1 and also reduce carbon monoxide (CO) and hydrogen carbide (HC) in the exhaust gas.

The engine 1 includes a cylinder block 4, which houses a crankshaft 3 as an engine output shaft and a piston (not shown). A cylinder head 5 is mounted on the cylinder block 4. The intake manifold 6 is disposed on a right side surface of the cylinder head 5, and the exhaust manifold 7 is disposed on a left side surface of the cylinder head 5. An upper surface side of the cylinder head 5 is covered with a head cover 8. Both front and back end sides of the crankshaft 3 are respectively protruded from both front and back side surfaces of the cylinder block 4. A cooling fan 9 is disposed on a front surface side of the engine 1. Rotational power is transmitted from a front end side of the crankshaft 3 to the cooling fan 9 through a cooling fan V belt 22.

A flywheel housing 10 is disposed on a back surface side of the engine 1. The flywheel housing 10 houses the flywheel 11 in a state in which the flywheel 11 is journaled to the back end side of the crankshaft 3. The rotational power of the engine 1 is transmitted from the crankshaft 3 to a working part of the working machine through the flywheel 11. An oil pan 12 storing lubricant is disposed on a lower surface of the cylinder block 4. The lubricant in the oil pan 12 is supplied to individual lubrication portions of the engine 1 through an oil filter 13 and the like disposed on the right side surface of the cylinder block 4, and is then returned to the oil pan 12.

A fuel supply pump 14 is disposed above the oil filter 13 (below the intake manifold 6) on the right side surface of the cylinder block 4. The engine 1 further includes injectors 15 corresponding to four cylinders, each having a fuel injection valve of electromagnetic on-off control type (not shown). Each of the injectors 15 is coupled to a fuel tank (not shown) mounted on the working machine with a fuel supply pump 14, a cylindrical-shaped common rail 16 (accumulator), and a fuel filter 17 interposed between the injector 15 and the fuel tank. The fuel in the fuel tank is pressure-fed from the fuel supply pump 14 to the common rail 16 through the fuel filter 17 and the high-pressure fuel is stored in the common rail 16. The fuel injection valves of the individual injectors 15 are subjected to open/close control so as to ensure that the high-pressure fuel in the common rail 16 is injected from the individual injectors 15 to the individual cylinders of the engine 1.

A cooling water pump 21 for cooling water circulation is disposed coaxially with a fan shaft of a cooling fan 9 on the front surface side of the cylinder block 4. The cooling water pump 21 is driven together with the cooling fan 9 through the cooling fan V belt 22 by rotational power of the crankshaft 3. Cooling water in a radiator (not shown) mounted on the working machine is supplied to the cylinder block 4 and the cylinder head 5 by driving the cooling water pump 21 so as to cool the engine 1. The cooling water after contributing to cooling the engine 1 is returned to the radiator. An alternator 23 is disposed on the left side of the cooling water pump 21.

Engine leg securing portions 24 are respectively disposed on the left and right side surfaces of the cylinder block 4. Engine leg bodies with anti-vibration rubber (not shown) are respectively bolted onto the engine leg securing portions 24. The engine 1 is supported in a vibration proof manner to the working machine (specifically an engine securing chassis) with the individual engine leg bodies interposed between the engine 1 and the working machine.

Figure 2:
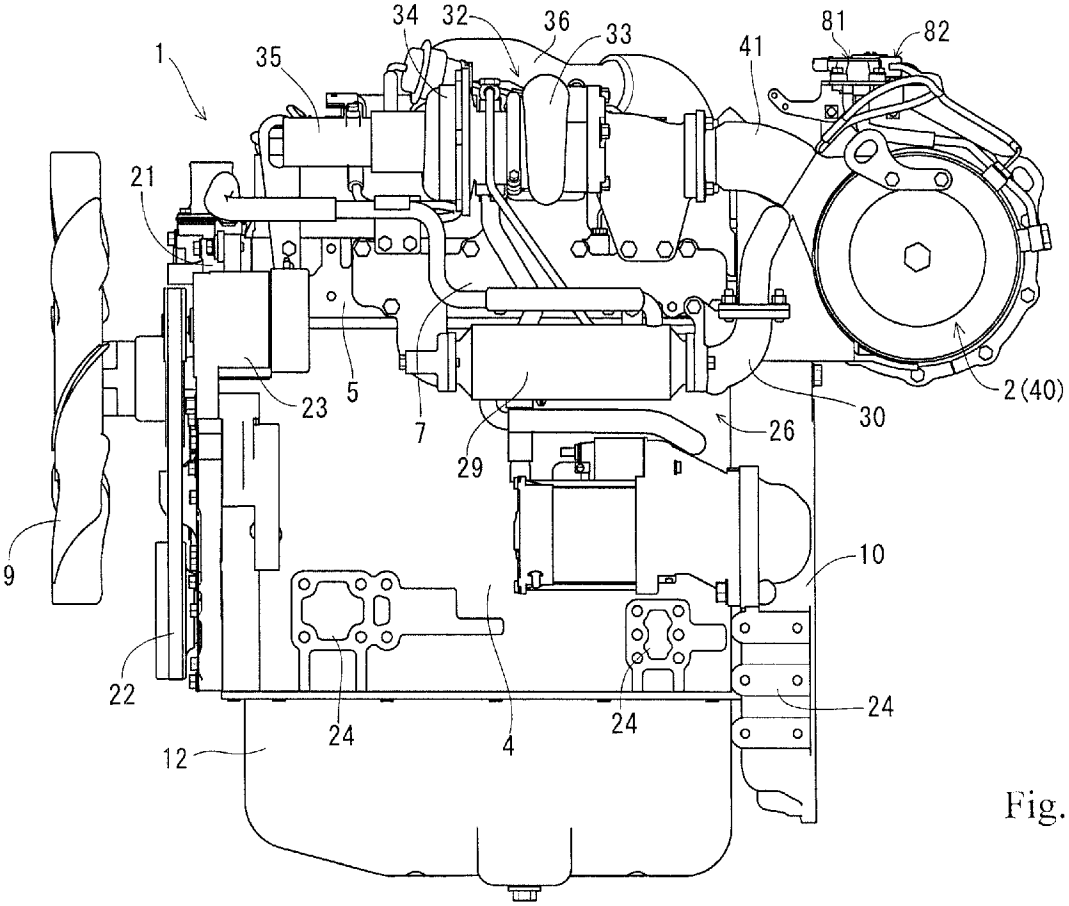
FIG. 2 is a left side view of the engine.
Figure 3:
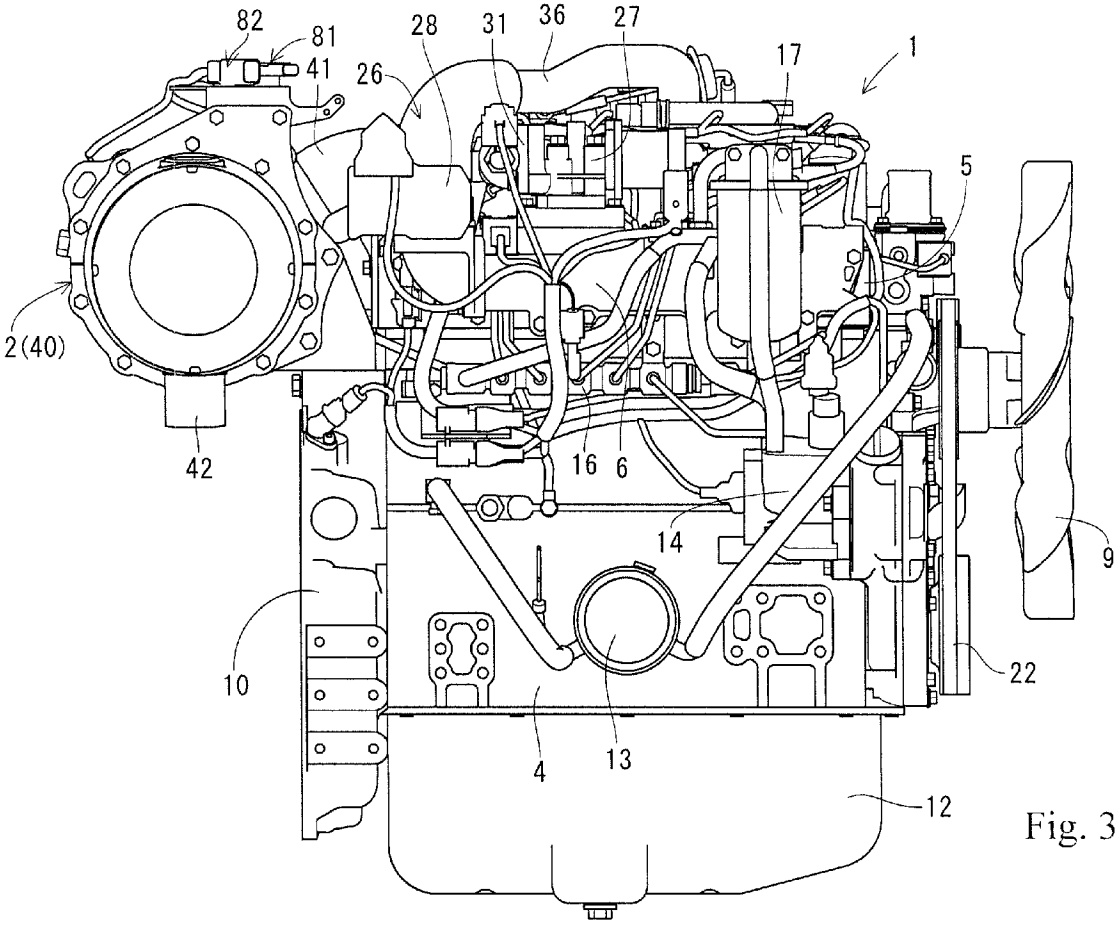
FIG. 3 is a right side view of the engine.
Figure 4:
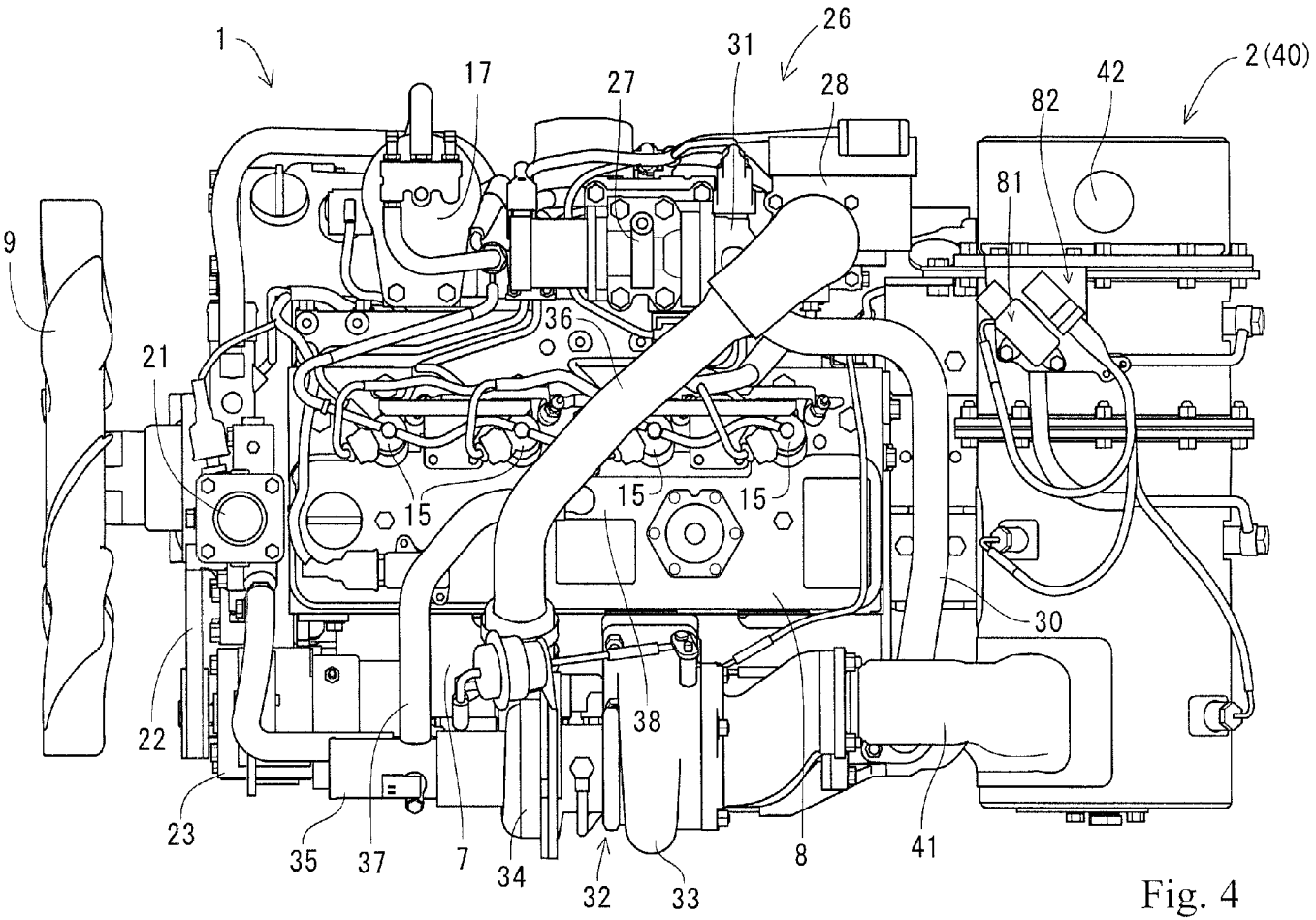
FIG. 4 is a plan view of the engine.
Figure 5:
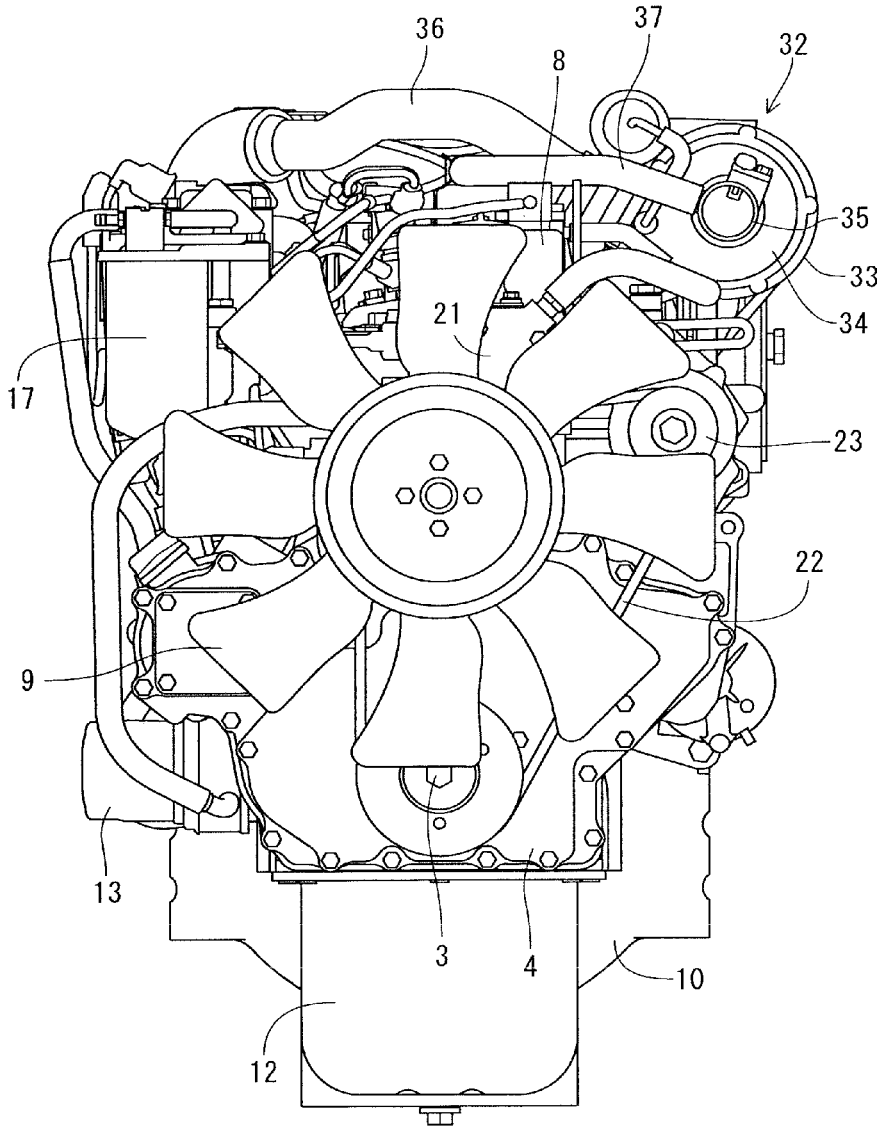
FIG. 5 is a front view of the engine.
Figure 6:
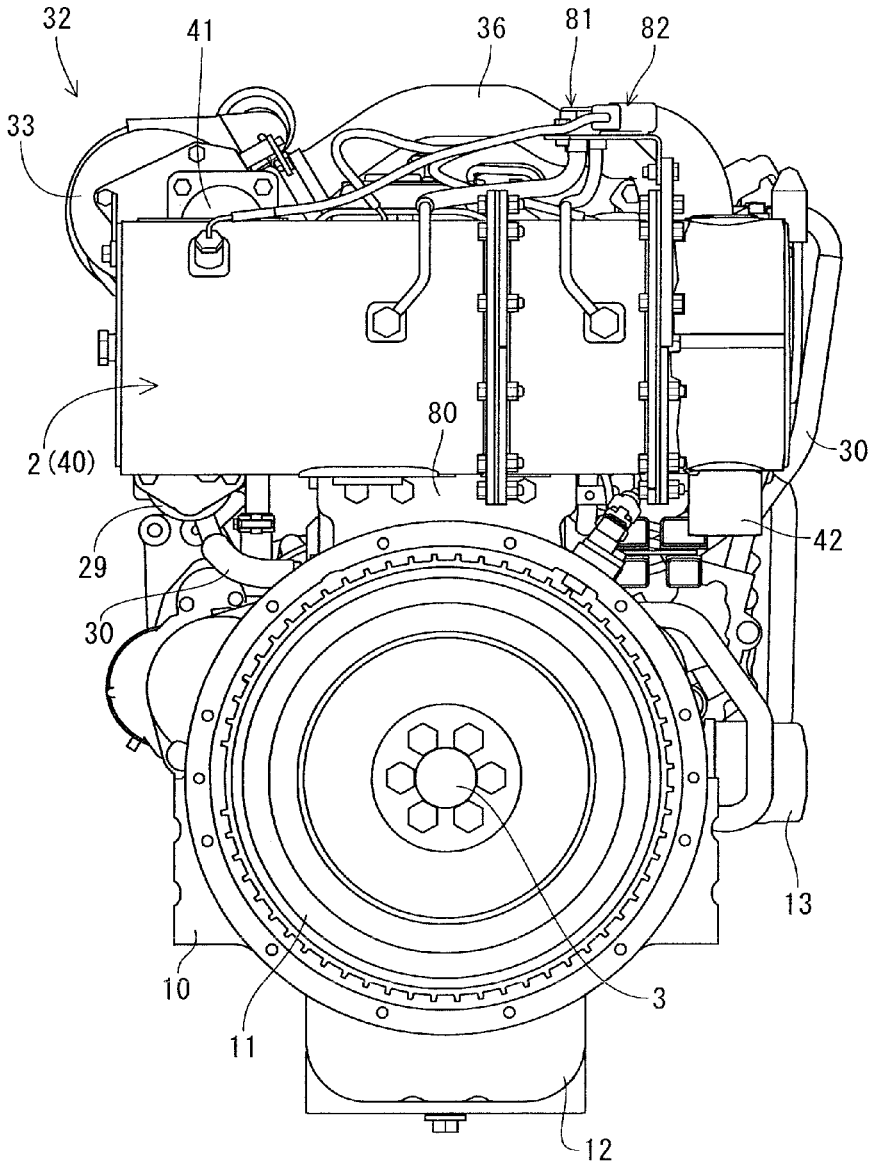
FIG. 6 is a rear view of the engine.

As shown in FIGS. 2 and 4, an inlet portion of the intake manifold 6 is coupled to an air cleaner (not shown) with an EGR device 26 (exhaust gas recirculation device) interposed between the intake manifold 6 and the air cleaner. Fresh air (outdoor air) taken into the air cleaner is subjected to dust removal and purification in the air cleaner and then fed through the EGR device 26 to the intake manifold 6 so as to be supplied to the individual cylinders of the engine 1.

The EGR device 26 includes an EGR body case 27 (collector), an intake throttle member 28, a recirculation exhaust gas pipe 30, and an EGR valve member 31. The EGR body case 27 mixes part of the exhaust gas of the engine 1 (EGR gas from the exhaust manifold 7) and fresh air (outdoor air from the air cleaner) together so as to be supplied to the intake manifold 6. The intake throttle member 28 allows the EGR body case 27 to communicate with the air cleaner. The recirculation exhaust gas pipe 30 is coupled to the exhaust manifold 7 with an EGR cooler 29 interposed between the recirculation exhaust gas pipe 30 and the exhaust manifold 7. The EGR valve member 31 allows the EGR body case 27 to communicate with the recirculation exhaust gas pipe 30.

The intake throttle member 28 is coupled to the intake manifold 6 with the EGR body case 27 interposed between the intake throttle member 28 and the intake manifold 6. The intake throttle member 28 is bolted onto one longitudinal end portion of the EGR body case 27. Left and right inward opening end portions of the EGR body case 27 are bolted onto the inlet portion of the intake manifold 6. An outlet side of the recirculation exhaust gas pipe 30 is coupled to the EGR body case 27 with the EGR valve member 31 interposed between the recirculation exhaust gas pipe 30 and the EGR body case 27. An inlet side of the recirculation exhaust gas pipe 30 is coupled to a lower surface side of the exhaust manifold 7 with the EGR cooler 29 interposed between the recirculation exhaust gas pipe 30 and the exhaust manifold 7. An amount of EGR gas supplied to the EGR body case 27 is adjusted by adjusting an opening of an EGR valve (not shown) in the EGR valve member 31.

With the foregoing configuration, the fresh air (outdoor air) is supplied from the air cleaner into the EGR body case 27 through the intake throttle member 28, while EGR gas (part of the exhaust gas discharged from the exhaust manifold 7) is supplied from the exhaust manifold 7 into the EGR body case 27 through the EGR valve member 31. The fresh air from the air cleaner and the EGR gas from the exhaust manifold 7 are mixed together in the EGR body case 27, and then mixed gas in the EGR body case 27 is supplied to the intake manifold 6. Thus, the part of the exhaust gas discharged from the exhaust manifold 7 is recirculated into the engine 1 through the intake manifold 6, thereby ensuring that a maximum temperature of combustion during high-load operation is lowered so as to reduce an amount of discharge of NOx (nitrogen oxide) from the engine 1.

As shown in FIGS. 1 to 5, a turbocharger 32 is disposed on the right side of the cylinder head 5 and above the exhaust manifold 7. The turbocharger 32 includes a turbine case 33 that houses a turbine wheel (not shown), and a compressor case 34 that houses a blower wheel (not shown). An exhaust inlet side of the turbine case 33 is coupled to an outlet portion of the exhaust manifold 7. An exhaust outlet side of the turbine case 33 is coupled to a tail pipe (not shown) with the DPF 2 interposed between the turbine case 33 and the tail pipe. The exhaust gas discharged from the individual cylinders of the engine 1 to the exhaust manifold 7 is released from the tail pipe to the outside through the turbine case 33 of the turbocharger 32, the DPF 2, and the like.

An intake inlet side of the compressor case 34 is coupled to the air cleaner with an intake pipe 35 interposed between the compressor case 34 and the air cleaner. An intake outlet side of the compressor case 34 is coupled to the intake throttle member 28 with a supercharging pipe 36 interposed between the compressor case 34 and the intake throttle member 28. The fresh air after subjected to the dust removal in the air cleaner is fed from the compressor case 34 to the intake manifold 6 through the intake throttle member 28 and the EGR body case 27 so as to be supplied to the individual cylinders of the engine 1. The intake pipe 35 is coupled to a breather chamber 38 in the head cover 8 with a blow-by gas return pipe 37 interposed between the intake pipe 35 and the breather chamber 38 (see FIG. 7). The blow-by gas after subjected to lubricant separation and removal in the breather chamber 38 is returned to the intake pipe 35 through the blow-by gas return pipe 37 and then reflowed to the intake manifold 6 so as to be resupplied to the individual cylinders of the engine 1.

(2) General Structure of DPF

A general structure of the DPF 2 will be described below by referring to FIGS. 7 to 10. The DPF 2 includes a purification casing 40 that is made of a heat-resistant metal material and includes a purification inlet pipe 41 and a purification outlet pipe 42. The purification casing 40 houses a diesel oxidation catalyst 43, such as platinum, and a honeycomb-structured soot filter 44, which are disposed side by side in series in a flow direction of exhaust gas (see an arrowed direction in FIG. 9). The diesel oxidation catalyst 43 generates nitrogen oxide ($NO_2$). The soot filter 44 continuously performs oxidation removal of collected particulate matter (PM) at a relatively low temperature. The purification inlet pipe 41 and the purification outlet pipe 42 are spaced apart on opposite sides (one end side and another end side) in a longitudinal direction of the purification casing 40. The purification inlet pipe 41 is coupled to the exhaust outlet side of the turbine case 33. The purification outlet pipe 42 is coupled to the tail pipe (not shown).

With the above configuration, the exhaust gas of the engine 1 flows from the exhaust outlet side of the turbine case 33 into the purification casing 40 through the purification inlet pipe 41. The exhaust gas then passes through the diesel oxidation catalyst 43 and the soot filter 44 in the order named so as to be subjected to purification process. The particulate matter in the exhaust gas is collected without passing through a porous partition wall between cells in the soot filter 44. Then, the exhaust gas after passing through the diesel oxidation catalyst 43 and the soot filter 44 is emitted toward the tail pipe.

When an exhaust gas temperature exceeds a reproducible temperature (for example, approximately 300° C.) during the time that the exhaust gas passes through the diesel oxidation catalyst 43 and the soot filter 44, nitric oxide (NO) in the exhaust gas is oxidized to unstable nitrogen dioxide by the action of the diesel oxidation catalyst 43. Then, oxygen (O) to be released from nitrogen dioxide when returning to nitric oxide oxidizes and removes particulate matter deposited on the soot filter 44, thereby ensuring that the soot filter 44 recovers particulate matter collection capability (the soot filter 44 reproduces itself).

In the present embodiment, another longitudinal end side of the purification casing 40 constitutes a muffler 45, and the purification outlet pipe 42 is disposed in the muffler 45. The diesel oxidation catalyst 43 and the soot filter 44 correspond to a filter body for purifying exhaust gas.

The purification casing 40 includes a catalyst inside case 46 and a catalyst outside case 47, a filter inside case 48 and a filter outside case 49, and a sound damping inside case 50 and a sound damping outside case 51. Combinations of the inside cases 46, 48, and 50, and the outside cases 47, 49, and 51 are respectively made into a double cylindrical structure. The diesel oxidation catalyst 43 is stored in the catalyst inside case 46. The soot filter 44 is housed in the filter inside case 48. A thin-plate support 52 having an L-shaped cross section is disposed between an outer circumferential side of the catalyst inside case 46 and an inner circumferential side of the catalyst outside case 47. The outer circumferential side of the catalyst inside case 46 and the inner circumferential side of the catalyst outside case 47 are coupled to each other with the thin plate support 52 interposed between the catalyst inside case 46 and the catalyst outside case 47.

The combinations of the inside cases 46 and 48, and the outside cases 47 and 49 correspond to a purification case as a component of the purification casing 40. Although the DPF 2 of the present embodiment includes the muffler 45, the muffler 45 is not the component indispensable for the DPF 2. That is, the sound damping inside case 50 and the sound damping outside case 51 are not components indispensable for the purification casing 40.

A catalyst inner lid body 53 is weldedly secured to one end side of each of the catalyst inside case 46 and the catalyst outside case 47 (an end portion on the exhaust upstream side). The one end side of each of the catalyst inside case 46 and the catalyst outside case 47 is closed by the catalyst inner lid body 53. A catalyst outer lid body 54 that externally covers the catalyst inner lid body 53 is weldedly secured to an outer end surface side of the catalyst inner lid body 53. The purification inlet pipe 41 is weldedly secured to an outer circumferential side of the catalyst outside case 47. The purification inlet pipe 41 communicates with the interior of the catalyst inside case 46 through an exhaust gas inlet 55 disposed on the catalyst inside case 46 and the catalyst outside case 47.

A thin plate-shaped catalyst flange 56 protruding toward an outer circumferential side (radially outside) of the catalyst outside case 47 is weldedly secured to another end side of the catalyst inside case 46 (an end portion on the exhaust downstream side). Another end side of the catalyst outside case 47 is weldedly secured to an outer circumferential side of the catalyst flange 56. A thin plate-shaped filter inlet flange 57 protruding toward an outer circumference of the filter outside case 49 is weldedly secured to a longitudinal middle portion on the outer circumferential side of the filter inside case 48. One end side of the filter outside case 49 (an end portion on the exhaust upstream side) is weldedly secured to an outer circumferential side of the filter inlet flange 57.

Figure 7:
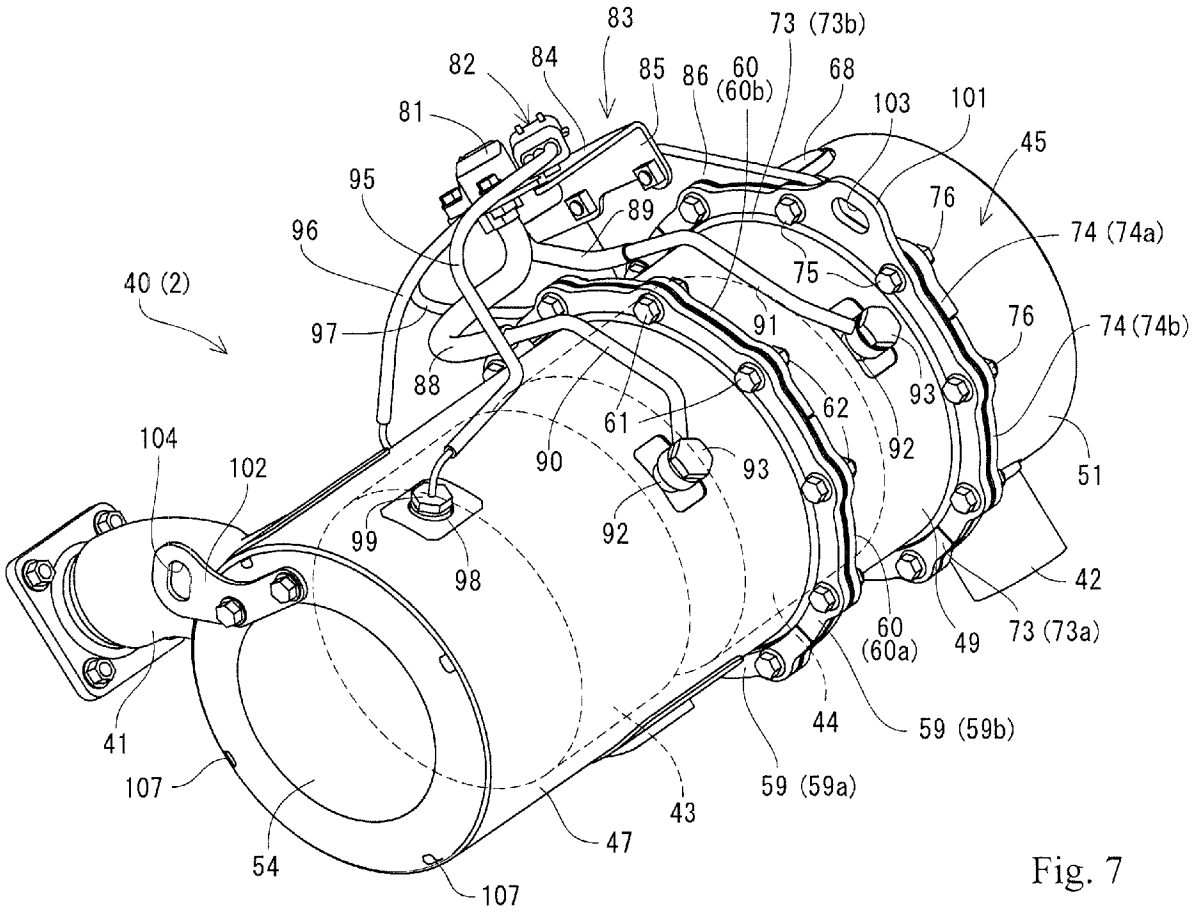
FIG. 7 is an external perspective view of a DPF as seen from a purification inlet pipe side.
Figure 8:
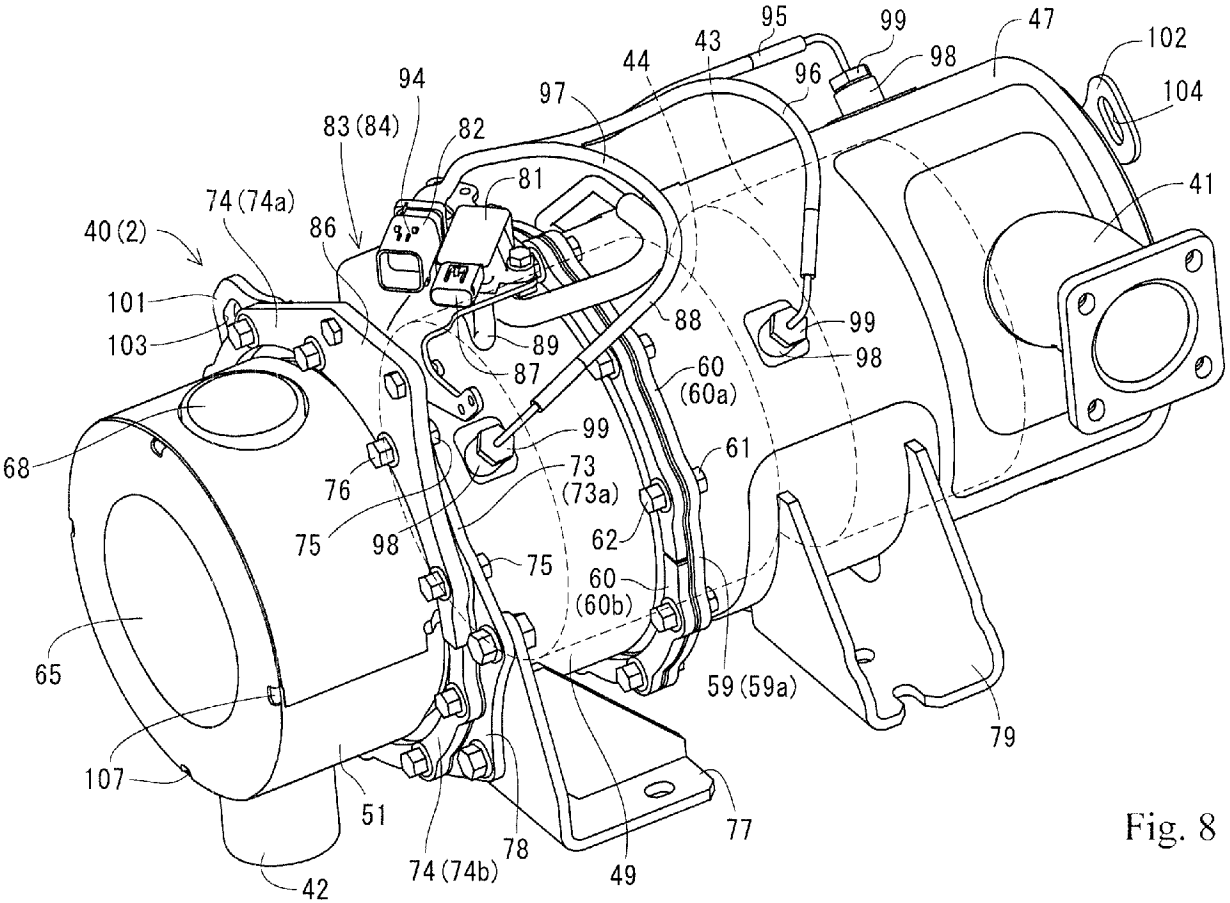
FIG. 8 is an external perspective view of the DPF as seen from a purification outlet pipe side.
Figure 9:
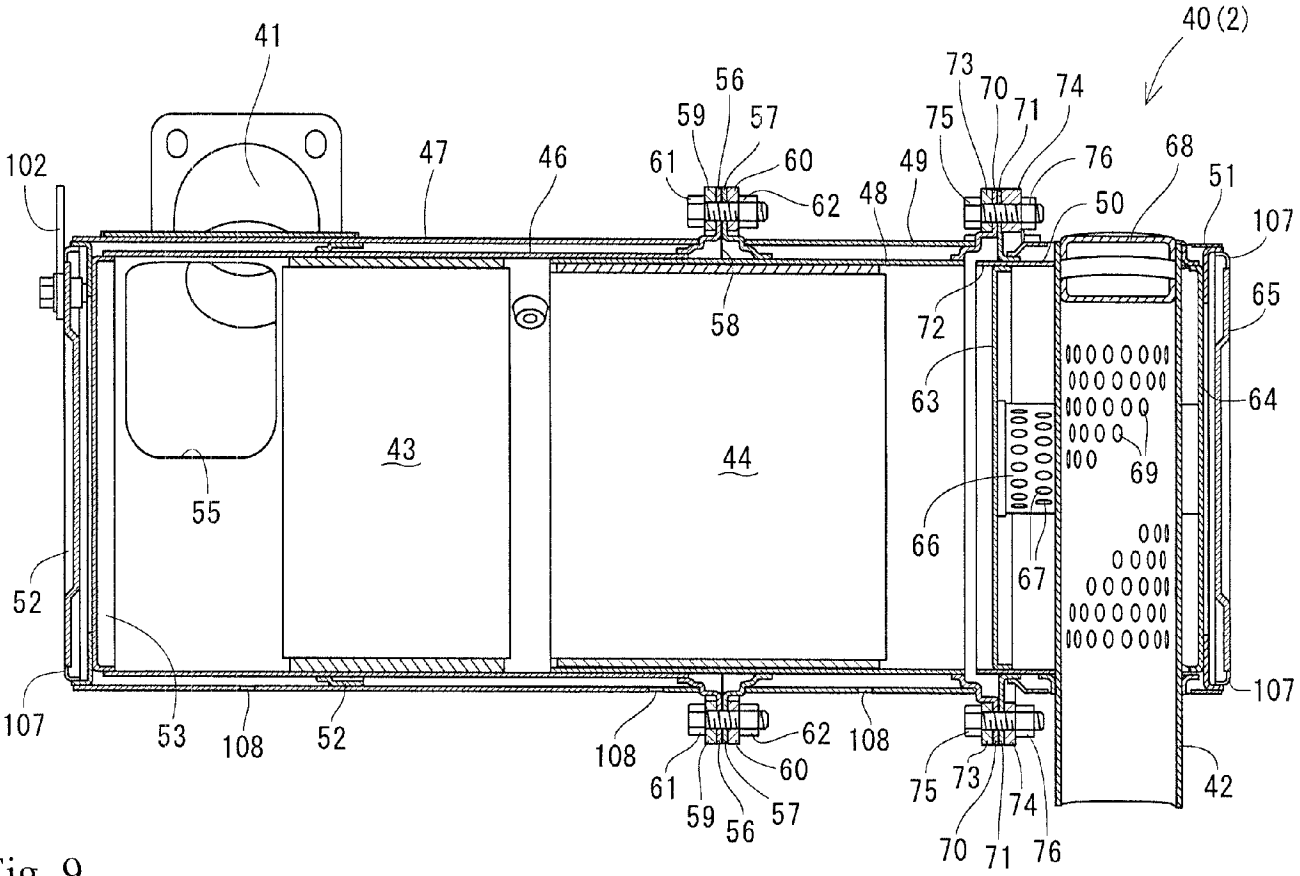
FIG. 9 is a cross-sectional explanatory drawing of the DPF.

As shown in FIGS. 7 to 9, the catalyst outside case 47 and the filter outside case 49 are coupled to each other by allowing the catalyst flange 56 and the filter inlet flange 57 to abut against each other with the gasket 58 interposed between the catalyst flange 56 and the filter inlet flange 57, and by holding the two flanges 56 and 57 from both sides in the exhaust gas flow direction by thick plate-shaped intermediate holding flanges 59 and 60 respectively surrounding outer circumferential sides of the outside cases 47 and 49, and by fastening the two intermediate holding flanges 59 and 60 together with the two flanges 56 and 57 by a bolt 61 and a nut 62. In a state in which the catalyst outside case 47 and the filter outside case 49 are coupled to each other, one end side of the filter inside case 46 is overlapped inward (inserted) from another end side of the catalyst inside case 46 and another end side of the catalyst outside case 47.

The muffler 45 located on the another longitudinal end side of the purification casing 40 includes the sound damping inside case 50 and the sound damping outside case 51 that constitute the double cylindrical structure. A partition lid body 63 is weldedly secured to one end side of the sound damping inside case 50 (an end portion on the exhaust upstream side). The one end side of the sound damping inside case 50 is closed by the partition lid body 63. A sound damping inner lid body 64 is weldedly secured to another end side (an end portion on the exhaust downstream side) of each of the sound damping inside case 50 and the sound damping outside case 51. A sound damping outer lid body 65 externally covering the sound damping inner lid body 64 is weldedly secured to an outer end surface side of the sound damping inner lid body 64.

A pair of communication pipes 66 (only one of which is shown in FIG. 9) are disposed between the partition lid body 63 and the sound damping inner lid body 64. One end side of each of the two communication pipes 66 extends through the partition lid body 63. Another end side of each of the two communication pipes 66 is closed by the sound damping inner lid body 64. A large number of communication holes 67 are disposed on the two communication pipes 66. An interior of the sound damping inside case 50 partitioned by the partition lid body 63 and the sound damping inner lid body 64 constitutes a resonant chamber that communicates with the two communication pipes 66 through the communication holes 67.

A purification outlet pipe 42 passing between the two communication pipes 66 extends through the sound damping inside case 50 and the sound damping outside case 51. A pair of outlet lid bodies 68 are weldedly secured to one end side (upper end side) of the purification outlet pipe 42. The one end side of the purification outlet pipe 42 is closed by the two outlet lid bodies 68. The two outlet lid bodies 68 are disposed vertically properly spaced apart from each other. A large number of exhaust holes 69 are disposed on a portion of the purification outlet pipe 42 located inside the sound damping inside case 50. Consequently, the two communication pipes 66 in the sound damping inside case 50 communicate with the purification outlet pipe 42 through the resonant chamber and the exhaust holes 69. Another end side (lower end side) of the purification outlet pipe 42 is coupled to, for example, the tail pipe and an existing sound damping member. With the above configuration, the exhaust gas that has entered the two communication pipes 66 in the sound damping inside case 46 passes through the purification outlet pipe 42 through the communication holes 67, the resonant chamber, and the exhaust holes 69 and is then to be discharged outside the muffler 45.

A thin plate-shaped filter outlet flange 70 overhanging toward the outer circumferential side of the filter outside case 49 is weldedly secured to another end side of the filter inside case 48. Another end side of the filter outside case 49 is weldedly secured to an outer circumferential side of the filter outlet flange 70. A thin plate-shaped sound damping flange 71 overhanging toward the outer circumferential side of the sound damping outside case 51 is weldedly secured to the one end side of the sound damping inside case 50. One end side of the sound damping outside case 51 is weldedly secured to an outer circumferential side of the sound damping flange 71.

As shown in FIGS. 7 to 9, the filter outside case 49 and the sound damping outside case 51 are coupled to each other by allowing the filter outlet flange 70 and the sound damping flange 71 to abut against each other with the gasket 72 interposed between the filter outlet flange 70 and the sound damping flange 71, and by holding the two flanges 70 and 71 from both sides in the exhaust gas flow direction by thick plate-shaped outlet holding flanges 73 and 74 respectively surrounding outer circumferential sides of the outside cases 49 and 51, and by fastening the two outlet holding flanges 73 and 74 together with the two flanges 70 and 71 by a bolt 75 and a nut 76.

The individual middle holding flange 59 (60) is made up of circular arc bodies 59*a* and 59*b* (60*a* and 60*b*) being divided into a plurality of ones in a circumferential direction of the corresponding outside case 47 (49). These circular arc bodies 59*a* and 59*b* (60*a* and 60*b*) are formed in a circular are shape (an approximately semicircular horseshoe-shape). In the state in which the catalyst outside case 47 and the filter outside case 49 are coupled to each other, end portions of the two circular arc bodies 59*a* and 59*b* (60*a* and 60*b*) are circumferentially opposed to each other and abutted against each other so as to surround the outer circumferential side of the catalyst outside case 47 (filter outside case 49). Here, an abutting portion between end portions of the circular arc bodies 59*a* and 59*b* on the catalyst side and an abutting portion between end portions of the circular arc bodies 60*a* and 60*b* on the filter inlet side are respectively disposed at positions having shifted phases (namely, the abutting portions are not overlapping with each other in an identical phase). The individual circular arc bodies 59*a*, 59*b*, 60*a*, and 60*b* constituting the middle holding flanges 59 and 60 have the same configuration.

Similarly to the middle holding flanges 59 and 60, each of the outlet holding flanges 73 (74) is made up of circular arc bodies 73*a* and 73*b* (74*a* and 74*b*) being divided into a plurality of ones in a circumferential direction of the corresponding outside case 49 (51). The individual circular arc bodies 73*a* and 73*b* (74*a* and 74*b*) have basically the same configuration as the individual circular arc bodies 59*a* and 59*b* (60*a* and 60*b*) of the middle holding flange 59 (60). An abutting portion between end portions of the circular arc bodies 73*a* and 73*b* on the filter outlet side and an abutting portion between end portions of the circular are bodies 74*a* and 74*b* on the sound damping side are respectively disposed at positions having shifted phases.

A coupling leg body 77 that allows the engine 1 to support the purification casing 40 is detachably secured to at least one of the holding flanges 59, 60, 73, and 74. In the present embodiment, a leg body fastening portion 78 with a through hole is disposed on the one circular arc body 73*a* in the outlet holding flange 73. The coupling leg body 77 includes a securing boss portion corresponding to the leg body fastening portion 78 of the circular arc body 73*a*. The securing boss portion of the coupling leg body 77 is bolted onto the leg body fastening portion 78 of the circular arc body 73*a*, thereby ensuring that the coupling leg body 77 is detachably secured to the outlet holding flange 73 on the filter outlet side. A securing leg body 79 that allows the engine 1 to support the purification casing 40 is weldedly secured to the outer circumferential side of the purification casing 40 (the catalyst outside case 47 in the present embodiment). The coupling leg body 77 and the securing leg body 79 are bolted onto a DPF securing portion 80 disposed on the upper surface side of the flywheel housing 10. That is, the DPF 2 is stably coupled to and supported on the flywheel housing 10 that is a highly rigid member by the coupling leg body 77 and the securing leg body 79.

As shown in FIGS. 7 and 8, the outer circumferential side of the purification casing 40 includes an exhaust gas pressure sensor 81 to detect an exhaust gas pressure in the purification casing 40, and an exhaust gas temperature sensor 82 to detect an exhaust gas temperature in the purification casing 40. The exhaust gas pressure sensor 81 detects pressure difference of exhaust gas between the exhaust upstream side and the exhaust downstream side with the soot filter 44 interposed between the exhaust upstream side and the exhaust downstream side. An amount of deposition of the particular matter on the soot filter 44 is converted based on the pressure difference so as to determine a clogging state in the DPF 2.

An approximately L-shaped planar sensor bracket 83 that supports the exhaust gas pressure sensor 81 and the exhaust gas temperature sensor 82 is detachable secured to at least one of the holding flanges 59, 60, 73, and 74. In the present embodiment, a sensor support portion 86 with a through hole is disposed on the one circular are body 74*a* in the outlet holding flange 74 on the sound damping side. That is, the sensor support portion 86 is disposed on a part of the outlet holding flange 74 on the sound damping side that is farthermost from the exhaust gas inlet 55. A vertical plate portion 85 of the sensor bracket 83 is bolted onto the sensor support portion 86 of the circular arc body 43*a*, thereby ensuring that the sensor bracket 83 is detachably secured to the outlet holding flange 74 on the sound damping side.

Figure 10:
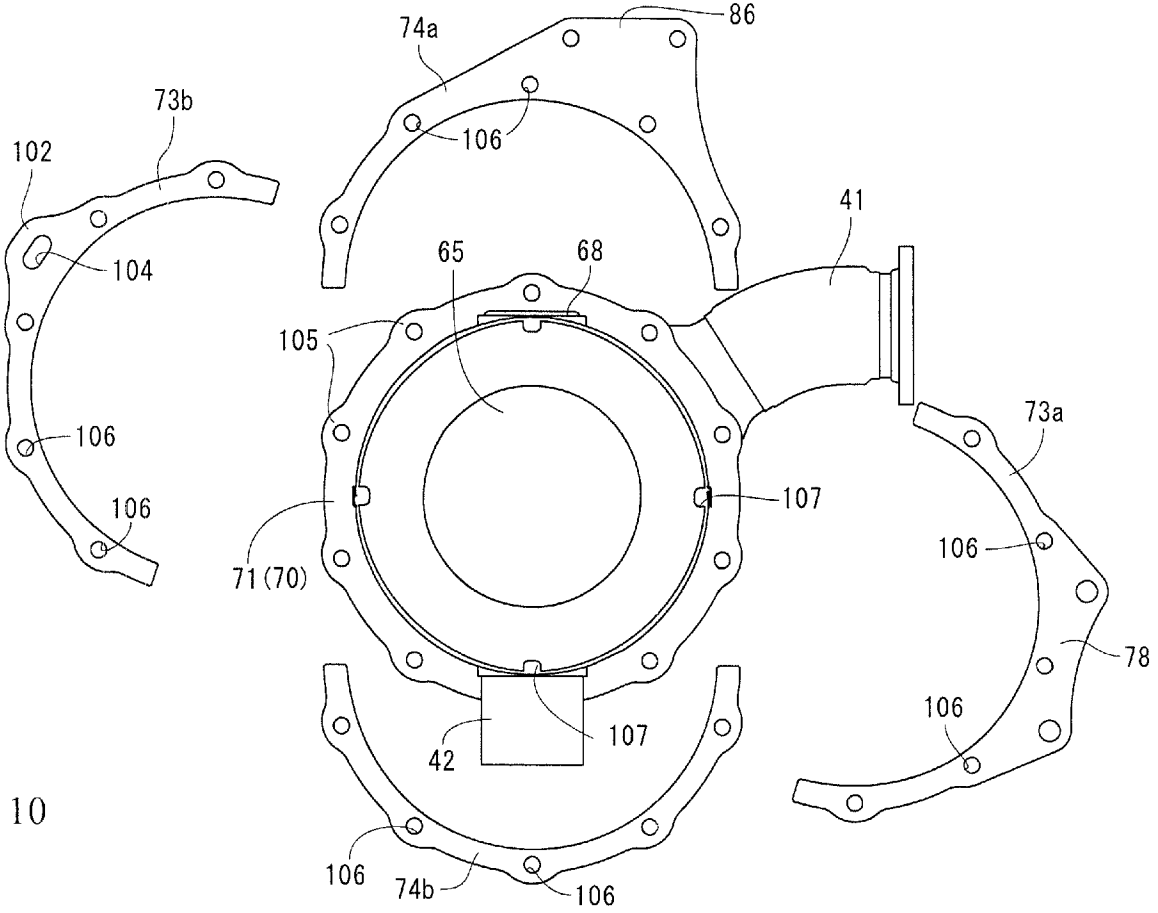
FIG. 10 is a separated side view of a holding flange.

As shown in FIGS. 7, 8, and 10, the sensor support portion 86 of the circular arc body 74*a* overhangs toward the outer circumferential side (radially outside) of the purification casing 40. Therefore, a horizontal plate portion 84 of the sensor bracket 83 is outwardly separated from the outer circumferential side of the purification casing 40. The exhaust gas pressure sensor 81 and the exhaust gas temperature sensor 82 are disposed side by side on the horizontal plate portion 84 of the sensor bracket 83. The horizontal plate portion 84 of the sensor bracket 83 is located adjacent to the outer circumferential side of the filter outside case 49 so that the two sensors 81 and 82 fit in a length range of the purification casing 40 in the exhaust gas flow direction. The above securing structure ensures that the two sensors 81 and 82 fit in the length range of the purification casing 40 in the exhaust gas flow direction even when the muffler 45 is directly secured to the DPF 2.

A wiring connector for pressure 87 is integrally disposed on the exhaust gas pressure sensor 81. Basal end sides of upstream and downstream pipe joint bodies 90 and 91 are respectively coupled to the exhaust gas pressure sensor 81 with upstream and downstream sensor pipes 88 and 89 respectively interposed therebetween. Boss bodies for pressure 92 are respectively weldedly secured to the catalyst inside case 46 and the filter inside case 48 in such a positional relationship as to surround the soot filter 44. Outward projections of the boss bodies for pressure 92 project radially outward from openings respectively disposed on the corresponding outside cases 47 and 49. Tip sides of the pipe joint bodies 90 and 91 are respectively fastened to the corresponding boss bodies for pressure 92 with a pipe joint bolt 93 interposed therebetween.

The exhaust gas temperature sensor 82 includes a wiring connector for temperature 94 disposed on the horizontal plate portion 84 of the sensor bracket 83. Three sensor wirings 95 to 97 extend from the exhaust gas temperature sensor 82 (which may be referred to as the wiring connector for temperature 94). Boss bodies for temperature 98 are respectively weldedly secured to the catalyst inside case 46 and the filter inside case 48. The two boss bodies for temperature 98 are disposed on the catalyst inside case 46, and the single boss bodies for temperature 98 is disposed on the filter inside case 48. Outward projections of the boss bodies for temperature 98 project radially outward from the openings disposed on the corresponding outside cases 47 and 49. Detection portions at the tips of the sensor wirings 95 to 97 extending from the exhaust gas temperature sensor 82 are passed through mounting bolts 99 respectively screwed on the boss bodies for temperature 98, thereby ensuring that the detection portions at the tips of the sensor wirings 95 to 97 are respectively secured to the boss bodies for temperature 98 with the corresponding mounting bolt 99 interposed therebetween. The detection portions at the tips of the sensor wirings 95 to 97 are respectively protruded between the catalyst inner lid body 53 and the diesel oxidation catalyst 43, between the diesel oxidation catalyst 43 and the soot filter 44, and between the soot filter 44 and the partition lid body 63.

In the present embodiment, the exhaust gas pressure sensor 81 and the exhaust gas temperature sensor 82 are secured onto the horizontal plate portion 84 of the sensor bracket 83 in a state in which coupling directions of the wiring connector for pressure 87 and the wiring connector for temperature 94 are oriented in the same direction. It is therefore ensured to improve work efficiency in connecting a wire to the connectors 87 and 94.

Further in the present embodiment, a hanging body 101 is integrally formed on the another circular arc body 73*b* in the outlet holding flange 73 on the filter outlet side, and a hanging fitting 102 is bolted onto the catalyst outer lid body 54 of the purification casing 40. The hanging body 101 and the hanging fitting 102 are spaced apart and opposed to each other on opposite sides in the exhaust gas flow direction (see FIG. 11) so that opening holes 103 and 104 are located in a diagonal direction of the purification casing 40 (in a direction intersecting a longitudinal axis A). Not only the outlet holding flange 73 on the filter outlet side, but also the holding flanges 59, 60, and 74 correspond to the thick plate flange for coupling the purification case. That is, the hanging body 101 may be integrally formed on the holding flanges 59, 60, and 74.

With the above configuration, in an assembly plant for the engine 1, or the like, the purification casing 40 can be mounted on the engine 1 by, for example, securing the hanging body 101 and the hanging fitting 102 to a hook of a chain block (not shown), and by lifting the purification casing 40 by the chain block so as to mount the purification casing 40 on the engine 1. That is, the purification casing 40 can be mounted smoothly on the engine 1 by using the hanging body 101 and the hanging fitting 102 without requiring an operator to raise the purification casing 40 by himself or herself.

Owing to the positional relationship between the hanging body 101 and the hanging fitting 102 in the diagonal direction, the purification casing 40 that is heavy is hangable in a stable posture. For example, it is easy to perform positioning between the DPF securing portion 80 of the flywheel housing 10, and the coupling leg body 77 and the securing leg body 79. It is therefore ensured to improve work efficiency in mounting the DPF 2.

As shown in FIG. 10, a plurality of bolt fastening portions 105, each having a through hole, are disposed at equal intervals along a circumferential direction on each of the holding flanges 59, 60, 73, and 74 corresponding to a thick plate flange. In the present embodiment, the ten bolt fastening portions 105 are provided for a group of the holding flanges 59, 60, 73, and 74. When the circular are bodies 59*a*, 59*b*, 60*a*, 60*b*, 73*a*, 73*b*, 74*a*, and 74*b* are viewed on an individual basis, the bolt fastening portions 105 are respectively disposed at five positions at equal intervals along the circumferential direction. Bolt holes 106 corresponding to the bolt fastening portions 105 of the holding flanges 59, 60, 73, and 74 are respectively disposed on the flanges 56, 57, 70, and 71. Therefore, a securing phase of a group of the circular arc bodies 59*a*, 59*b*, 60*a*, 60*b*, 73*a*, 73*b*, 74*a*, and 74*b* in the holding flanges 59, 60, 73, and 74 is changeable at multistage around the longitudinal axis A in the exhaust gas flow direction in the purification casing 40 (along the circumferential direction of the purification casing 40).

With the above configuration, the position of the hanging body 101 with respect to a coupling direction of the purification inlet pipe 41 and the purification outlet pipe 42 (a specification for mounting the DPF 2 on the engine 1) can be changed easily without changing the shape of the holding flanges 59, 60, 73, and 74 (a forming position of the hanging body 101). This contributes to further improving the work efficiency in mounting the DPF 2.

As shown in detail in FIG. 9, the lid bodies to close both end portion of the purification casing 40 in the exhaust gas flow direction are respectively made into the double structure made up of the inner lid bodies 53 and 64 and the outer lid bodies 54 and 65. A first drain hole 107 to drain water that accumulates between the inner lid bodies 53 and 64 and the outer lid bodies 54 and 65 is disposed on at least a portion located at a lower part of each of the outer lid bodies 54 and 65 in a state in which the purification casing 40 is mounted on the engine 1 (see FIGS. 7 to 11). The outer lid bodies 54 and 65 are formed in the same shape of approximately disk shape. The first drain hole 107 is disposed on a peripheral edge portion in a radial direction based on a centerline in the exhaust gas flow direction (the longitudinal axis A) in the outer lid bodies 54 and 65. The first drain holes 107 of the present embodiment communicate with peripheral edges in four directions as viewed from the centerline in the exhaust gas flow direction (the longitudinal axis A) (namely, communicating with four portions with respect to each of the outer lid bodies 54 and 65). Clearances between the inner lid bodies 53 and 64 and the outer lid bodies 54 and 65 communicate with the exterior through the first drain holes 107.

In a general DPF, dew condensation may occur due to an exhaust gas temperature drop and ingress of rainwater may occur, and consequently water, such as condensed water, may often remain in the interior of the DPF. The water has strong corrosiveness and exerts adverse effects on a case constituting an outline of the DPF. Particularly, in a DPF having a double structure, the water may remain in space between inside and outside cases and lid bodies for closing both end portions of these cases in an exhaust gas flow direction, and space between the inside case and the outside case. It is therefore necessary to remove the water.

With the foregoing configuration coping with the above problem, both end portions of the purification casing 40 in the exhaust gas flow direction are closed by the double structure made up of the inner lid bodies 53 and 64 and the outer lid bodies 54 and 65 so as to ensure heat insulation properties, while the water that accumulates between the inner lid bodies 53 and 64 and the outer lid bodies 54 and 65 due to water condensation, rainwater, or the like can be discharged from the first drain holes 107 so as to improve water draining capability of the DPF 2. This contributes to improving corrosion resistance of the DPF 2. Furthermore, both end portions of the purification casing 40 in the exhaust gas flow direction are closed by the outer lid bodies 54 and 65 having the same shape. This leads to a decrease in the number of components so as to contribute to cost savings. A mounting direction around the centerline (longitudinal axis A) of the outer lid bodies 54 and 65 with respect to the individual end portions of the purification casing 40 in the exhaust gas flow direction can be changed easily without changing the shape of the outer lid bodies 54 and 65. Consequently, it is ensured to enhance latitude of a mounting direction of the outside cases (for example, the catalyst outside case 47 and the sound damping outside case 51) with respect to the engine 1.

Figure 12:
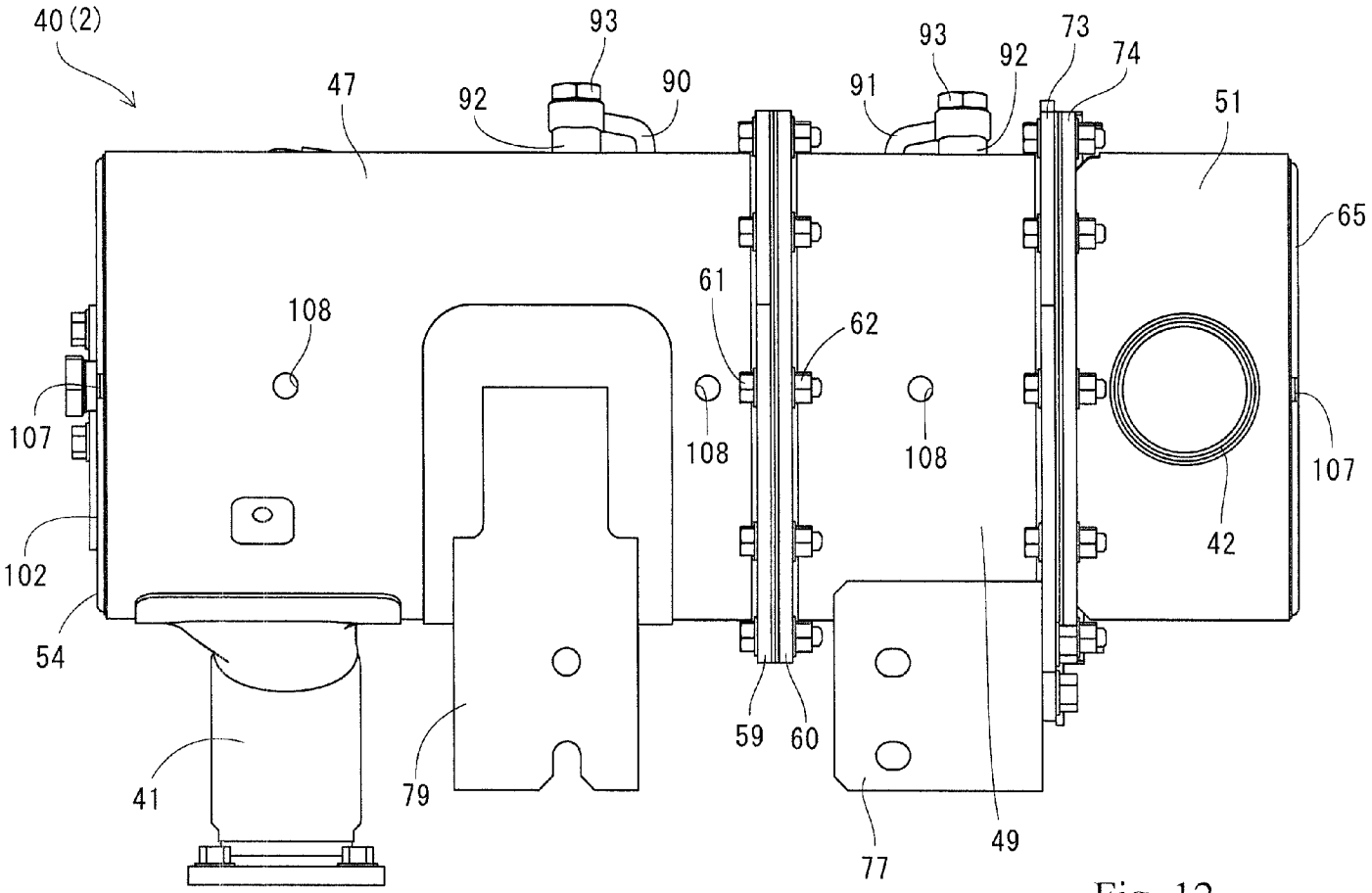
FIG. 12 is a bottom view of the DPF.

As shown in FIG. 12, a second drain hole 108 to drain water that accumulates between the inside cases 46 and 48 and the outside cases 47 and 49 is disposed on at least a portion located at a lower part of each of the outside cases 47 and 49 in the state in which the purification casing 40 is mounted on the engine 1. In the present embodiment, the second drain hole 108 is disposed on three locations, namely, on both sides of the catalyst outside case 47 with the securing leg body 79 interposed therebetween, and on the filter outside case 49. With this configuration, the purification casing 40 is made into the double structure made up of the inside cases 46 and 48 and the outside cases 47 and 49 so as to ensure heat insulation properties, while the water that accumulates between the inside cases 46 and 48 and the outside cases 47 and 49 due to water condensation, rainwater, or the like can be discharged from the second drain holes 108 so as to improve the water draining capability of the DPF 2. This contributes to further improving the corrosion resistance of the DPF 2.

(3) Summary

As apparent from the foregoing configurations, the exhaust emission control device 2 includes the plurality of filter bodies 43 and 44 to purify the exhaust gas discharged from the engine 1, the purification casing 40 including the plurality of purification cases 46 to 49 that respectively house the filter bodies 43 and 44, the exhaust gas pressure sensor 81 to detect the exhaust gas pressure in the purification casing 40, and the exhaust gas temperature sensor 82 to detect the exhaust gas temperature in the purification casing 40. In the exhaust emission control device 2, the two sensors 81 and 82 are disposed on the outer circumferential side of the purification casing 40 so as to fit in the length range in the purification casing 40 in the exhaust gas flow direction. It is therefore unnecessary to evaluate the suitability of initial setting (adjustment) of the individual sensors 81 and 82 for every specification of the engine 1 and every working machine. This ensures reduction in the man-hours for evaluations of design, test. This also achieves standardization of the components related to the exhaust emission control device 2. The mounting positions of the two sensors 81 and 82 fit in the length range in the purification casing 40 in the exhaust gas flow direction. This eliminates the influence of the two sensors 81 and 82 on the full length of the purification casing 40 (exhaust emission control device 2) in the exhaust gas flow direction, and consequently ensures the compact layout of the exhaust emission control device 2 including the two sensors 81 and 82 in layout space for the engine 1.

The sensor bracket 83 is detachably secured to the sensor support portion 86 disposed on the part of the flanges 59, 60, 73, and 74 in the group of the purification cases 46 to 49, and the two sensors 81 and 82 are disposed on the sensor bracket 83. Therefore, the two sensors 81 and 82 are supported on the highly rigid flanges 59, 60, 73, and 74 so as to reduce the vibrations transmitted to the two sensors 81 and 82. It is therefore ensured to suppress the adverse effects on the detection accuracy of the two sensors 81 and 82. It is also ensured to prevent the two sensors 81 and 82 from falling.

Further, the sensor support portion 86 is disposed on the part of the flange 74 that is farthermost from the exhaust gas inlet 55 in the group of the purification cases 46 to 49. The horizontal plate portion 84 of the sensor bracket 83 lies at the position outwardly apart from the outer circumferential side of the purification casing 40. The two sensors 81 and 82 are disposed side by side on the horizontal plate portion 84. Therefore, the heat generated from the exhaust emission control device 2 is less likely to be transmitted to the two sensors 81 and 82. Hence, though the two sensors 81 and 82 are incorporated in the exhaust emission control device 2, it is ensured to suppress malfunction of the two sensors 81 and 82 due to overheat. Moreover, the exhaust emission control device 2 and the two sensors 81 and 82 are close to each other, and hence the length of the individual sensor pipes 88, 89, and 95 to 97 that couple the exhaust emission control device 2 and the two sensors 81 and 82 can be set short so as to improve the mounting work efficiency and achieve cost savings.

Figure 11:
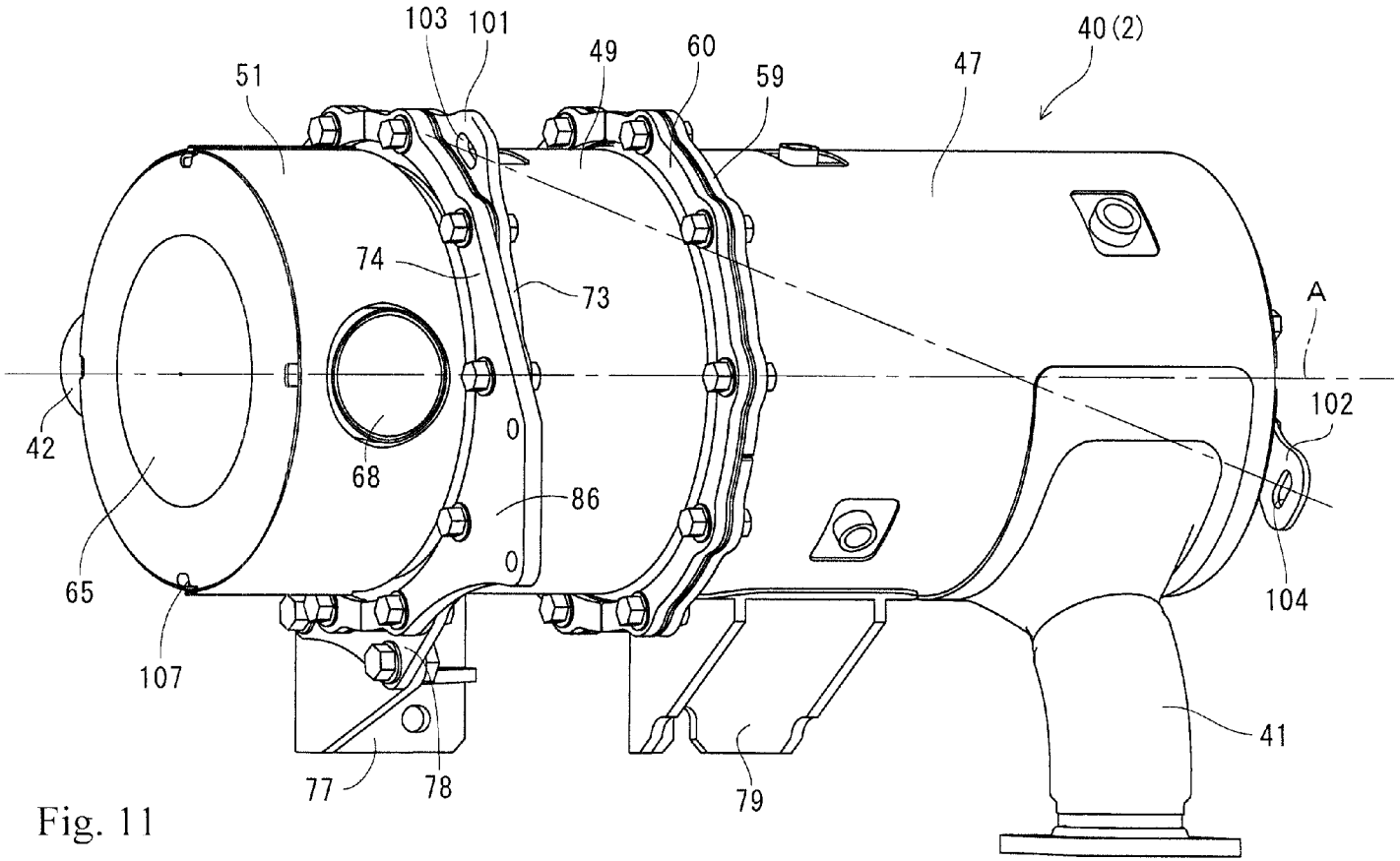
FIG. 11 is an external perspective view of the DPF showing a positional relationship of a hanging body and a hanging fitting.

As apparent from the foregoing description and FIGS. 7, 8, and 11, the exhaust emission control device 2 includes the plurality of filter bodies 43 and 44 to purify the exhaust gas discharged from the engine 1, and the purification casing 40 made up of the plurality of purification cases 47, 49, and 51 that house the filter bodies 43 and 44. In the exhaust emission control device 2, the purification casing 40 is configured by disposing the purification cases 47, 49, and 51 side by side in the exhaust gas flow direction, and by coupling these cases by the thick plate flanges 59, 60, 73, and 74. The hanging body 101 is integrally formed on the thick plate flange 73. Hence, for example, in the assembly plant for the engine 1, or the like, the purification casing 40 can be mounted on the engine 1 by, for example, securing the hanging body 101 and the hanging fitting 102 to the hook of the chain block (not shown), and by lifting the purification casing 40 by the chain block so as to mount the purification casing 40 on the engine 1. That is, the purification casing 40 can be mounted smoothly on the engine 1 by using the hanging body 101 and the hanging fitting 102 without requiring the operator to raise the purification casing 40 by himself or herself.

As apparent from the foregoing description and FIG. 11, the hanging body 101 is disposed on the one end side of the purification casing 40 in the exhaust gas flow direction, while the hanging fitting 101 is disposed on the another end side of the purification casing 40 in the exhaust gas flow direction. The hanging body 101 and the hanging fitting 102 are spaced apart and opposed to each other on the opposite sides in the exhaust gas flow direction so that the opening holes 103 and 104 are located in the direction intersecting the longitudinal axis A in the purification casing 40 in the exhaust gas flow direction. Owing to the positional relationship between the hanging body 101 and the hanging fitting 102 in the diagonal direction, the purification casing 40 that is heavy is hangable in the stable posture, and, for example, it is easy to perform the positioning between the DPF securing portion 80 of the flywheel housing 10, and the coupling leg body 77 and the securing leg body 79. It is therefore ensured to improve the work efficiency in mounting the exhaust emission control device 2.

As apparent from the foregoing description and FIGS. 10 and 11, the mounting angle of the thick plate flanges 59, 60, 73, and 74 is changeable around the longitudinal axis A in the purification casing 40 in the exhaust gas flow direction. The position of the hanging body 101 with respect to the coupling direction of the purification inlet pipe 41 and the purification outlet pipe 42 (the specification for mounting the exhaust emission control device 2 on the engine 1) can be changed easily without changing the shape of the holding flanges 59, 60, 73, and 74 (the forming position of the hanging body 101). This contributes to further improving the work efficiency in mounting the exhaust emission control device 2.

As apparent from the foregoing description and FIGS. 7 to 12, the exhaust emission control device includes the plurality of filter bodies 43 and 44 to purify the exhaust gas discharged from the engine 1, the plurality of inside cases 46, 48, and 50 that house the filter bodies 43 and 44, and the plurality of outside cases 47, 59, and 51 that house the inside cases 46, 48, and 50. The purification casing 40 is configured by disposing and coupling the outside cases 47, 49, and 51 side by side in the exhaust gas flow direction. In the exhaust emission control device, the lid bodies to close both end portions of the purification casing 40 in the exhaust gas flow direction are made into the double structure made up of the inner lid bodies 53 and 64 and the outer lid bodies 54 and 65. The first drain hole 107 to drain the water that accumulates between the inner lid bodies 53 and 64 and the outer lid bodies 54 and 65 is disposed on at least the portion located at the lower part of each of the outer lid bodies 54 and 65 in the state in which the purification casing 40 is mounted on the engine 1. Accordingly, both end portions of the purification casing 40 in the exhaust gas flow direction are closed by the double structure made up of the inner lid bodies 53 and 64 and the outer lid bodies 54 and 65 so as to ensure heat insulation properties, while the water that accumulates between the inner lid bodies 53 and 64 and the outer lid bodies 54 and 65 due to water condensation, rainwater, or the like can be discharged from the first drain holes 107 so as to improve the water draining capability of the exhaust emission control device 2. This contributes to improving corrosion resistance of the exhaust emission control device 2.

The first drain holes 107 are respectively disposed at the positions in the radial direction based on the centerline in the exhaust gas flow direction (the longitudinal axis A) in the outer lid bodies 54 and 65. Therefore, both end portions of the purification casing 40 in the exhaust gas flow direction are closable by the outer lid bodies 54 and 65 having the same shape. This leads to the decrease in the number of components so as to contribute to cost savings. The mounting direction around the center line (longitudinal axis A) of the outer lid bodies 54 and 65 with respect to the individual end portions of the purification casing 40 in the exhaust gas flow direction can be changed easily without changing the shape of the outer lid bodies 54 and 65. Consequently, it is ensured to enhance the latitude of the mounting direction of the outside cases (for example, the catalyst outside case 47 and the sound damping outside case 51) with respect to the engine 1.

Further, the second drain holes 108 to drain the water that accumulates between the inside cases 46 and 48 and the outside cases 47 and 49 is disposed on at least the portion located at the lower part of each of the outside cases 47 and 49 in the state in which the purification casing 40 is mounted on the engine 1. Therefore, the purification casing 40 is configured in the double structure made up of the inside cases 46 and 48 and the outside cases 47 and 49 so as to ensure heat insulation properties, while the water that accumulates between the inside cases 46 and 48 and the outside cases 47 and 49 due to water condensation, rainwater, or the like can be discharged from the second drain holes 108 so as to improve the water draining capability of the exhaust emission control device 2. This contributes to further improving the corrosion resistance of the exhaust emission control device 2.

The present invention may be embodied in various forms without being limited to the foregoing embodiment. The configurations of the individual components in the present invention are not limited to those in the illustrated embodiment, but different modifications may be made therein without departing from the spirit and scope of the present invention.

DESCRIPTION OF THE REFERENCE NUMERAL

1 Engine
2 DPF (exhaust emission control device)
40 Purification casing
41 Purification inlet pipe
42 Purification outlet pipe
43 Diesel oxidation catalyst
44 Soot filter
46 Catalyst inside case
47 Catalyst outside case
48 Filter inside case
49 Filter outside case
55 Exhaust gas inlet
56 Catalyst flange
57 Filter inlet flange

59, 60 Middle holding flange
70 Filter outlet flange
71 Sound damping flange
73, 74 Outlet holding flange
81 Exhaust gas pressure sensor
82 Exhaust gas temperature sensor
83 Sensor bracket
84 Horizontal plate portion
86 Sensor support portion
107 First drain hole
108 Second drain hole

The invention claimed is:

1. An exhaust emission control device comprising:

a plurality of filter bodies configured to purify exhaust gas discharged from an engine;

a purification casing comprising a plurality of purification cases respectively housing the plurality of filter bodies;

an exhaust gas pressure sensor configured to detect an exhaust gas pressure in the purification casing;

an exhaust gas temperature sensor configured to detect an exhaust gas temperature in the purification casing; and wherein the exhaust gas pressure sensor and the exhaust gas temperature sensor are disposed along an outer circumferential side of the purification casing so as to fit in a length range of the purification casing in an exhaust gas flow direction;

wherein said plurality of the purification cases comprise a plurality of inside cases respectively housing the plurality of filter bodies and a plurality of outside cases respectively housing the plurality of inside cases, the plurality of outside cases being coupled to each other side by side in the exhaust gas flow direction;

wherein the purification casing in the exhaust flow direction has a first end portion and a second end portion, and wherein a first lid portion closes the first end portion and a second lid portion closes the second end portion, each one of the first lid portion and second lid portion comprising an inner lid body, an outer lid body, and a first drain hole; and wherein the first drain hole is configured to drain water that accumulates between the inner lid body and the outer lid body and is disposed on at least a portion located at a lower part of the outer lid body in a state in which the purification casing is mounted on the engine.

2. The exhaust emission control device according to claim 1, further comprising a sensor bracket, wherein a flange of the end outside case has a sensor support portion to which said sensor bracket is detachably secured, and the exhaust gas pressure sensor and the exhaust gas temperature sensor are disposed on the sensor bracket; and wherein an end portion of the purification casing constitutes a muffler, said plurality of filter bodies being absent from said muffler, said muffler being delimited longitudinally by an end outside case among said plurality of outside cases, said end outside case having an outlet pipe through which the purified exhaust gas is emitted, said outside end case having a shortest longitudinal length among said plurality of outside case.

3. The exhaust emission control device according to claim 2, wherein a horizontal plate portion of the sensor bracket is located at a position outwardly separated from an outer circumferential side of the purification casing, and wherein the exhaust gas pressure sensor and the exhaust gas temperature sensor are disposed side by side on the horizontal plate portion.

4. The exhaust emission control device according to claim 1, wherein the first drain hole of each one of the first lid portion and second lid portion is disposed at a position in a radial direction based on a centerline in the exhaust gas flow direction in the respective outer lid body.

5. The exhaust emission control device according to claim 1, wherein for at least each one of the plurality of outside cases other than a one of the plurality of outside cases constituting a muffler, said at least each one of the plurality of outside cases comprises a second drain hole configured to drain water that accumulates between the plurality of inside cases and the plurality of outside cases.

6. The exhaust emission control device according to claim 4, wherein for at least each one of the plurality of outside cases other than a one of the plurality of outside cases constituting a muffler, said at least each one of the plurality of outside cases comprises a second drain hole configured to drain water that accumulates between the plurality of inside cases and the plurality of outside cases.

* * * * *